United States Patent [19]

Raleigh et al.

[11] Patent Number: 4,663,613

[45] Date of Patent: May 5, 1987

[54] PROTECTIVE SYSTEM FOR HOT TUB WATER AND POWER SUPPLY

[75] Inventors: William F. Raleigh, Valencia; Patrick J. Keegan, Van Nuys, both of Calif.

[73] Assignee: Teledyne Industries, Inc., Los Angeles, Calif.

[21] Appl. No.: 757,472

[22] Filed: Jul. 22, 1985

[51] Int. Cl.[4] ..... G08B 21/00

[52] U.S. Cl. ..... 340/607; 340/407; 210/97; 210/181; 4/544; 4/545

[58] Field of Search ..... 340/607, 407; 374/143; 210/97, 181; 4/507, 509, 545, 544

[56] References Cited

U.S. PATENT DOCUMENTS

| | | | |
|---|---|---|---|
| 4,153,003 | 5/1979 | Willis | 116/268 |
| 4,385,724 | 5/1983 | Ramsauer et al. | 4/545 |
| 4,500,874 | 2/1985 | Jacobi et al. | 340/607 |
| 4,545,906 | 10/1985 | Frederick | 210/181 X |

*Primary Examiner*—Glen R. Swann, III
*Assistant Examiner*—Jeffery A. Hofsass
*Attorney, Agent, or Firm*—Benoit Law Corporation

[57] ABSTRACT

A tub is supplied with hot water through a water circulation system including a pump, a water filter and an electric flow-through heater energized through an electric contactor upon closure thereof. A user of the tub is urged to service the water circulation system upon clogging thereof. For this purpose, water flow fluctuations occurring in the circulation system upon restriction of the water circulation system are sensed and closure of the contactor is precluded for a time interval of predetermined duration in response to a sensing of water flow fluctuations. That predetermined duration is made sufficiently short for a resumption of the heater energization through reclosure of the contactor if the fluctuations are only transient, but sufficiently long to effect the reduction of water temperature in the tub supplied through the heater by restricting reclosure of the contactor as long as the fluctuations continue, so as to indicate to the user of the tub through the reduced water temperature a need to service the water circulation system.

19 Claims, 1 Drawing Figure

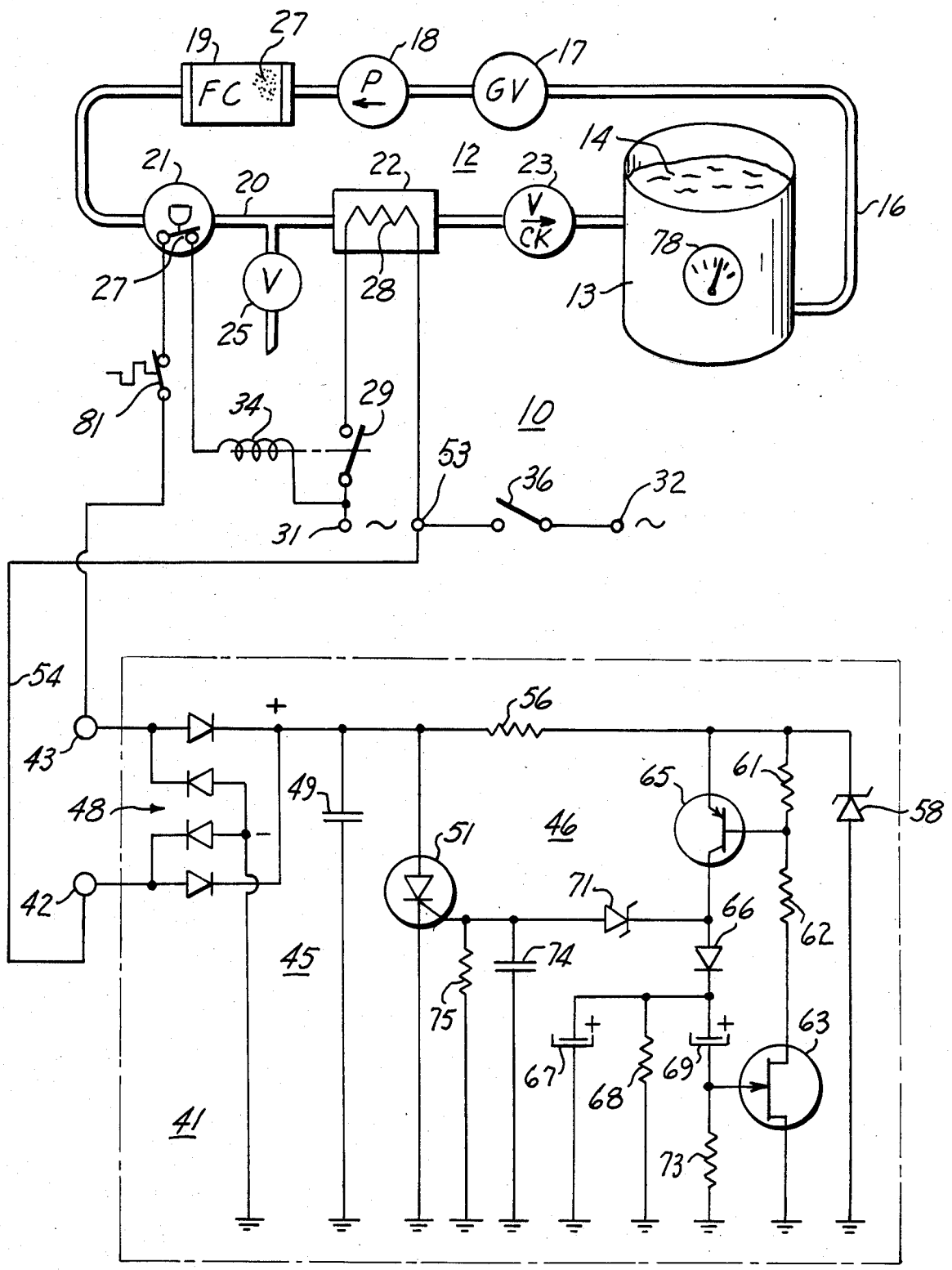
FC
P
GV
V
CK
V
10
12
13
14
16
17
18
19
20
21
22
23
25
27
28
29
31
32
34
36
41
42
43
45
46
48
49
51
53
54
56
58
61
62
63
65
66
67
68
69
71
73
74
75
78
81

PROTECTIVE SYSTEM FOR HOT TUB WATER AND POWER SUPPLY

BACKGROUND OF THE INVENTION

1. Field of the Invention

The subject invention relates to spa and hot tub systems and installations and to protective systems for their water and power supplies.

2. Information Disclosure Statement

Systems for supplying a tub with hot water through a water circulation system including a pump, a water filter and an electric flow-through heater energized through an electric contactor upon closure thereof, have become increasingly popular in recent years and, for present purposes, include so-called spas, as well as other washing or bathing systems of similar dimensions.

One problem with such systems, in which water is circulated vigorously and heated very rapidly, has been that components were vulnerable to damage before the user of the tub or system could do anything about it.

This contrasted the area of technology under consideration from other fields, such as airconditioning, electric control, and keyboard systems, where safeguards have existed for a long time against hunting, bouncing and similar detrimental effects. However, despite such developments in other fields, contactors in hot tub heating systems became burned and other problems occurred, when the user of the tub remained ignorant of a clogging of the water filter or other part of the water circulation system.

SUMMARY OF THE INVENTION

It is a general object of this invention to overcome the disadvantages and to meet the needs expressed or implicit in the above Information Disclosure Statement or in other parts hereof.

It is a germane object of this invention to apprize the user of a hot tub or similar facility of a need to service the water filter or circulation system.

It is a related object of this invention to save the water and power supply system of a hot tub against hunting, bouncing and similar adverse effects.

It is also an object of this invention to safeguard contactors of electric flow-through heaters against contact burning, melting and welding, and against other effects of recurrent actuation and deactivation in response to surges and fluctuations in the water circulation system.

Other objects of the invention will become apparent in the further course of this disclosure.

From one aspect thereof, the subject invention resides in a method, apparatus or system for supplying a tub with hot water through a water circulation system including a pump, a water filter and an electric flow-through heater energized through an electric contactor upon closure thereof. The invention, more specifically, resides in the improvement of urging a user of the tub to service the water circulation system upon clogging thereof, comprising in combination steps of, or means for, sensing in that circulation system water flow fluctuations occurring upon restriction of the water circulation system, precluding closure of the contactor for a time interval of predetermined duration in response to sensing of the water flow fluctuations, and making that predetermined duration sufficiently short for a resumption of the heater energization through reclosure of the contactor if the fluctuations are only transient, but sufficiently long to effect a reduction of water temperature in the tub supplied through the heater by restricting reclosure of the contactor as long as the fluctuations continue, to indicate to a user of the tub through the reduced water temperature a need to service the water circulation system.

Other aspects of the invention are apparent from the remainder of this disclosure, and no restriction to any aspect, object, or feature, is intended by this Summary of this Invention.

BRIEF DESCRIPTION OF THE DRAWING

The subject invention and its various objects and aspects will become more readily apparent from the following detailed description of the preferred embodiment of the invention illustrated by way of example in the accompanying drawing, which diagrammatically shows a water circulation heating system for a hot tub and schematically an electronic control therefor.

DESCRIPTION OF PREFERRED EMBODIMENT

The hot tub installation 10 shown in the drawing has a water circulation and heating system 12 for supplying a tub 13 with hot water 14. The circulation system includes a return pipe 16 connected to a bottom region of the tub, a gate valve 17, a pump 18 and a water filter 19, all connected in series in the return flow pipe 16, as well as in a supply flow pipe 20.

Also connected in series in the supply side pipe 20 are a sensor 21, electric flow-through heater 22 and optional check valve 23. Typically, the supply pipe issues into an upper region of the tub 13 and, also typically, generates a whirl or jet of water at any predetermined desired location in the tub or at another washing or bathing facility.

Water may be removed from the system through a drain valve 25 which, if desired, may be situated at a location other than the one shown therefor in the drawing. There may also be provided a water supply valve for filling or replenishing the circulation system with water. However, no such supply valve has been shown in the drawing, since water may simply be supplied through the open top of the tub 13 or through a separate conduit leading thereto.

The sensor 21 senses in the circulation system 12 water flow fluctuations occurring upon restriction of the water circulation system by contaminants 27, illustrated in the drawing by a cluster of dots at the filter 19. It should, however, be understood that contaminants can occur in other parts of the system as well, and that restrictions can occur in the system for reasons other than contamination.

Typically, when the pump 18 operates against contaminants 27 in the filter 19 or in another part of the circulation system, surges will develop therein. The sensor 21 will pick up the water flow fluctuations manifested by such surges. A conventional pressure or paddle-type flow switch may be employed in the sensor 21.

The sensor 21, as illustrated, has a normally closed contact 27 which opens in response to water flow fluctuations. As long as the contact 27 is closed, an electric resistance element 28 in the flow-through heater may be energized via a contactor 29 from an electric power source symbolized by terminals 31 and 32.

To this end, the contactor 29 has an electromagnetic coil 34 or other electrically energizable actuating means for effecting closure of the contactor 29 or its main contacts.

The coil 34 is connected in series with the normally closed contact 27 of the sensor 21. In this manner, the contactor 29 may be closed upon actuation of a main switch 36, as long as the sensor contact 27 is and remains closed.

On the other hand, if water flow fluctuations in the circulation system 12 cause the sensor switch 27 to open and close intermittently, then the contactor 29 will also open and close intermittently in prior-art systems.

In this respect, the potentially most damaging action to which the contactor 29 is subjected is a partial opening of its contacts. In other words, if the contactor starts to open and the inductive component of its load impedence causes an arc to be struck between the contacts, the contact surface may melt at the location of the arc. If the sensor contact 27 then recloses, before the arc is extinguished, the hot, molten surfaces of the contacts at 29 are slammed together, causing further contact damage and sometimes even welding of the contacts to each other.

However, even if no welding of contacts takes place, the contactor 29 still will be damaged if water flow fluctuations in the circulation system 12 and intermittent actuation of the sensor contact 27 cause the contactor to chatter through rapidly recurring energization and deenergization of the coil 34.

The subject invention prevents such detrimental occurrences and even gives the user of the tub a meaningful indication that the filter 19 may need servicing or replacement, or that another part of the circulation system 12 needs unclogging or servicing.

In particular, the subject invention precludes closure of the contactor 29 for a time interval of predetermined duration in response to the sensing of water flow fluctuations at 21. This, in practice, may take many forms, but the illustrated preferred embodiment of the invention provides for this purpose an electronic circuit 41 that represents a two-terminal device that may be connected in series with the sensor contact 27 and contactor coil 35 as shown in the drawing or in another appropriate manner.

To this end, the protective circuit 41 has a pair of terminals 42 and 43, either one of which may serve as a power input terminal, while the other acts as a power output terminal. This renders the protective circuit 41 very convenient as a retrofit device, which may be inserted at any practical point of the contactor energizing circuit, without significant modification of existing systems.

The protective device 41 may be considered as consisting of two parts; namely, a power switching circuit 45 and a timing circuit 46 connected thereto. The power switching circuit comprises a diode bridge 48, bypass capacitor 49 and silicon controlled rectifier 51 or other gateable semiconductor device.

In principle, the diode bridge 48 could be omitted, if only a unidirectional operation is desired or feasible or if a thyristor or other bidirectional gateable semiconductor device is employed at 51.

However, the illustrated embodiment represents the best mode currently perceived of carrying the subject invention into effect.

It may be noted in this respect that the protective circuit 41 is adapted in design to an American 220 to 240 volt alternating-current system, in which the voltage is that of two phases with a central neutral ground. However, the teaching of the subject invention is universal and, once perceived, may easily be adapted to other kinds of electric power supply systems.

In the illustrated embodiment of the invention, alternating-current power is applied to the protective circuit terminal 42 from an output 53 of the main switch 36 via an electric line 54.

The diode bridge 48 represents a full-wave rectifier, which converts alternating-current power received through terminals 42 and 43 into a direct current for operation of the protective circuit 41.

If SCR 51 is not conducting, the timing circuit 46 presents the load impedence across the bridge 48. The primary component of that load impedence is a resistor 56 which, by way of example, was a 75 kilohm resistor in a prototype of the timing circuit 46.

That phase of operation is the high-impedance state of the protective circuit 41. In that high-impedance state, the coil 34 does not receive sufficient energizing current for closing the contactor 29, even if the sensor contact 27 should intermittently close. In particular, the timing circuit 46 operates in the high-impedance state to preserve that state despite intermittent closures of contact 27.

If the SCR 51 is conducting, then the protective circuit 41 is in its low-impedence mode, in which the total impedance of that circuit consists of the three diode drops during the particular alternating-current half cycle; namely, the drops of two of the diodes in the bridge 48, plus the drop of the conducting SCR 51. The capacitor 49 thereby acts as a bypass for high-frequency, high-voltage spikes which may be produced by the load.

For an analysis of the timing circuit 46, let us start with the assumption that the protective circuit 41 is in the low-impedence mode and that the electric power applied at 31, 32 has just passed through a zero-current mode. At that point, the SCR 51 shuts off. As the AC waveform rises, a voltage appears across SCR 51 and current flows through resistor 56. This causes a voltage to appear across a zener diode 58. Series-connected resistors 61, 62 and field-effect transistor 63 are in parallel to the zener diode 58. The FET 63 preferably is an N-channel, junction type field-effect transistor.

In the low-impedance state, FET 63 is conducting and its drain current flows through resistor 61 and 62, having their junction tied to the base of a PNP transistor 65. This causes the transistor 65 to conduct and the voltage across zener diode 58 to appear also at the anode of a logic diode 66.

As the voltage rises, diode 66 will conduct and the voltage will appear across a capacitor 67, across a resistor 68, and at a positive terminal of a timing capacitor 69. Capacitor 67 will charge directly and timing capacitor 69 through the gate-drain junction of FET 63.

When the voltage reaches the threshold of a zener diode 71, that diode will start to conduct and current will flow through the cathode-gate junction of SCR 51, which causes that SCR to turn on, shorting the positive and negative terminals of the diode bridge 58 together, whereby the voltage across the zener diode 58 falls to zero.

Capacitors 67 and 69, which have been charged to the zener voltage, start to discharge through resistor 68. The RC time constant of capacitor 67 and resistor 68 is such that the gate of FET 63 remains above the pinch-off voltage until the next zero crossing of the alternating-current waveform occurs. Accordingly, because of the relatively small capacitor 67 and resistor 68, the FET 63 will be conducting when the voltage starts to rise again across zener diode 58.

If primary power is interrupted for from one to five cycles of the alternating current, capacitor 67 will discharge and the voltage on the gate of FET 63 will fall below the pinch-off level, whereby that FET 63 will stop conducting. This will, for instance, take place if the sensor 21 opens its contact 27 in response to water flow fluctuations in the circulation system 12.

If power is reapplied when the sensor contact 27 recloses, the voltage across zener diode 58 will rise as before, but transistor 65 will not be conducting, since there is now no current flow through FET 63. Accordingly, since transistor 65 is not conducting, there is no gate current to the SCR 51. Accordingly, that SCR does not turn on, and the protective circuit 41 is in the high-impedance mode. The larger timing capacitor 69 will continue to discharge through resistor 68 and a further timing resistor 73, until the voltage on the gate of FET 63, to which the junction of timing components 69 and 73 is connected, rises above the FET pinch-off level.

At this point, FET 63 will turn back on, switching the protective circuit 41 back to the low-impedance mode, in which the coil 34 is capable of reclosing the contactor 29 when the sensor switch 27 is closed.

In the illustrated preferred embodiment, a bypass capacitor 74 is connected in parallel to the pull-down resistor 75 for the gate of the SCR 51, since the coil 34 presents an inductive load that, at the above mentioned power supply voltage, can cause voltage spikes in the one-thousand volt area. Capacitor 74 then prevents SCR 51 from acting like a zener diode or being otherwise inadvertently turned on.

The timing circuit 46 predetermines the duration of the time interval for which closure of the contactor 29 is precluded. In particular, the timing circuit makes that predetermined duration sufficiently short for a resumption of the energization of the heater 22 through reclosure of the contactor if the fluctuations sensed at 21 are only transient. In that case, the continual energization of the heater at 28 is such that the water temperature in the tub 13 will essentially be retained.

On the other hand, the timing circuit 46 renders the predetermined duration of the contactor opening interval sufficiently long to effect a reduction in water temperature in the tub 13 supplied through the heater 22, by restricting reclosure of the contactor 29 as long as the water flow fluctuations in the circulation system 12 continue.

The actual duration of the time interval for which reclosure of the contactor 29 is precluded is large enough to prevent significant damage to the contactor 29, but short enough to permit continued heating of the tub when the contact 27 remains closed.

As an approximate practical value, the duration of the time interval may be 25 seconds each. The protective circuit 41 permits reclosing of the contactor 29 after that time interval, but restarts that interval in the above mentioned manner, if water flow fluctuations continue to be sensed at 21.

Accordingly, if water flow fluctuations continue in the circulating system through clogging at 27 or otherwise, the water temperature in the tub 13 will decline through repeated prevention of the reclosure of contactor 29 and of energization of heater 22. A thermometer 78 may be employed in or at the tub, or in the line between heater 22 and tub 13, to indicate the temperature of the heated water 14. Of course, a person immersed in the tub can also feel when the water temperature is significantly declining.

The protective circuit 41 with timing circuit 46 and especially RC timing components 68, 69 and 73, thus effect a reduction of water temperature indicating a need to service the water circulation system 12. In this respect, a user can be trained through instruction to check not only the power supply and main switch 36, but also the filter 19, when the water temperature in the tub declines significantly. For instance, the filter 19 may be provided in the form of an exchangeable filter cartridge, which can readily be inspected for contamination by the user of the tub. If the user's suspicion in this respect is verified through inspection, the filter 19 is exchanged in response to the above mentioned reduction in water temperature. If, on the other hand, the filter appears to be free of contaminants, then the user should have the circulating system 12 checked for contaminants and cleaned as necessary.

It is an advantage of the subject invention that all this can be done before there is any damage to the contactor 29 or any other part of the system. In most instances, replacement of a filter cartridge at 19 is all that is required for the installation to resume its normal operation.

As may be seen from the drawings, the illustrated embodiment provides the contactor 29 with electrically energizable actuating means 34 and, through SCR 51, gates electric energizing current to actuating means 34 for effecting closure of the contactor 29. The timing circuit 46 then interrupts energization of the actuating means 34 for the predetermined duration for each time interval after a sensed water flow fluctuation.

Where gateable semiconductor means are connected in series with the actuating means 34, such semiconductor means 51 are gated to an ON condition for effecting energization of the actuating means and closure of the contactor 29. Alternatively, the semiconductor means 51 are gated to an OFF condition for the above mentioned predetermined duration for each time interval. The illustrated embodiment provides a timing circuit 46 for establishing that predetermined duration.

As a particularly advantageous feature thereof, the illustrated embodiment provides a two-terminal device 41 for precluding closure of the contactor for the predetermined duration, and for effecting reclosure of that contactor as disclosed above. The two-terminal device 41 is connected in series with electrically energizable actuating means 34 of the contactor, and such actuating means are selectively energized and deenergized with the two-terminal device 41. A normally closed temperature sensor 81 effects opening or prevents closure of the contactor 29 when the temperature of the water 14 becomes excessive.

In the illustrated embodiment, the series connection of the two-terminal device 41 extends through the sensor contact 27.

Accordingly, existing hot tub installations or circuitry can very easily be retrofitted with the two-terminal device 41 according to the subject invention or preferred embodiments thereof.

The subject extensive disclosure suggests and renders apparent to those skilled in the art various modifications and variations within the spirit and scope of the subject invention and equivalents thereof.

We claim:

1. In a method of supplying a tub with hot water through a water circulation system including a pump, a water filter and an electric flow-through heater energized through an electric contactor upon closure thereof, the improvement of urging a user of the tub to service said water circulation system upon clogging thereof, comprising in combination the steps of:

sensing in said circulation system water flow fluctuations occurring upon restriction of said water circulation system;

precluding closure of said contactor for a time interval of predetermined duration in response to sensing of said water flow fluctuations; and making said predetermined duration sufficiently short for a resumption of said heater energization through reclosure of said contactor if said fluctuations are only transient, but sufficiently long to effect a reduction of water temperature in said tub supplied through said heater by restricting reclosure of said contactor as long as said fluctuations continue, to indicate to a user of said tub through said reduced water temperature a need to service said water circulation system.

2. A method as claimed in claim 1, including the step of:

servicing said filter in response to said reduction in water temperature.

3. A method as claimed in claim 1, including the step of:

reclosing said contactor after said time interval, but restarting said interval if water flow fluctuations continue.

4. A method as claimed in claim 3, including the step of:

servicing said filter in response to said reduction in water temperature.

5. A method as claimed in claim 1, including the steps of:

providing said contactor with electrically energizable actuating means;

electrically energizing said actuating means for effecting said closure of the contactor; and interrupting energization of said actuating means for said predetermined duration for each time interval.

6. A method as claimed in claim 1, including the steps of:

providing said contactor with electrically energizable actuating means;

gating electric energizing current to said actuating means for effecting said closure of the contactor; and interrupting energization of said actuating means for said predetermined duration for each time interval.

7. A method as claimed in claim 1, including the steps of:

providing said contactor with electromagnetically energizable actuating means;

connecting gateable semiconductor means in series with said actuating means;

gating said semiconductor means to an ON condition for effecting energization of said actuating means and said closure of the contactor; and gating said semiconductor means to an OFF condition for said predetermined duration for each time interval.

8. A method as claimed in claim 7, including the steps of:

providing a timing circuit for establishing said predetermined duration.

9. A method as claimed in claim 1, including the steps of:

providing a two-terminal device for precluding closure of said contactor for said predetermined duration, and for effecting reclosure of said contactor;

connecting said two-terminal device in series with electrically energizable actuating means of said contactor; and selectively energizing and deenergizing said actuating means with said two-terminal device.

10. In a system for supplying a tub with hot water through a water circulation system including a pump, a water filter and an electric flow-through heater energized through an electric contactor upon closure thereof, the improvement of urging a user of the tub to service said water circulation system upon clogging thereof, comprising in combination:

means for sensing in said circulation system water flow fluctuations occuring upon restriction of said water circulation system;

means connected to said sensing means for precluding closure of said contactor for a time interval of predetermined duration in response to sensing of said water flow fluctuations; and means in said precluding means for making said predetermined duration sufficiently short for a resumption of said heater energization through reclosure of said contactor if said fluctuations are only transient, but sufficiently long to effect a reduction of water temperature in said tub supplied through said heater by restricting reclosure of said contactor as long as said fluctuations continue, to indicate to a user of said tub through said reduced water temperature a need to service said water circulation system.

11. A system as claimed in claim 10, including:

means for reclosing said contactor after said interval, but for restarting said interval if water flow fluctuations continue.

12. A system as claimed in claim 10, wherein:

said contactor has electrically energizable actuating means;

said system includes means connected to said actuating means for electrically energizing said actuating means to effect said closure of the contactor; and said precluding means include means for interrupting said energization of said actuating means for said predetermined duration for each time interval.

13. A system as claimed in claim 10, wherein:

said contactor has electrically energizable actuating means;

said system includes means connected to said actuating means for gating electric energizing current to said actuating means for effecting said closure of the contactor; and said precluding means include means for interrupting energization of said actuating means for said predetermined duration for each time interval.

14. A system as claimed in claim 10, said contactor has electromagnetically energizable actuating means;

said system includes gateable semiconductor means in series with said actuating means;

said system includes means for gating said semiconductor means to an ON condition for effecting energization of said actuating means and said closure of the contactor; and said precluding means include means for gating said semiconductor means to an OFF condition for said predetermined duration for each time interval.

15. A system as claimed in claim 14, including:

a timing circuit for establishing said predetermined duration.

16. A system as claimed in claim 10, including:

a two-terminal device including said means for precluding closure of said contactor for said predetermined duration, and including means for effecting said reclosure of said contactor.

17. A system as claimed in claim 16, wherein:

said two-terminal device is connected in series with said sensing means.

18. A system as claimed in claim 16, wherein:

said contactor has electrically energizable actuating means; and said two-terminal device is connected in series with said sensing means and said actuating means.

19. A system as claimed in claim 18, wherein:

said two-terminal device has a timing circuit for establishing said predetermined duration.

* * * * *